United States Patent [19]

Wallberg

[11] 4,052,096

[45] Oct. 4, 1977

[54] HYDRAULICALLY OPERATED GRAPPLE OR TIMBER FORK

[75] Inventor: Karl Erik Wallberg, Lulea, Sweden

[73] Assignee: Kewaco AB, Lulea, Sweden

[21] Appl. No.: 671,816

[22] Filed: Mar. 30, 1976

[30] Foreign Application Priority Data

Apr. 3, 1975 Sweden ..... 7503830

[51] Int. Cl.[2] ..... B66C 1/00

[52] U.S. Cl. ..... 294/88; 214/147 G; 214/654

[58] Field of Search ..... 294/88, 67 AB, 67 EA, 294/67 BC, 103, 106, 108, 110, 111, 112; 214/147 G, 147 R, 654

[56] References Cited

U.S. PATENT DOCUMENTS

| | | | |
|---|---|---|---|
| 2,873,874 | 2/1959 | Best et al. | 214/654 |
| 3,120,898 | 2/1964 | Eaves | 214/654 |
| 3,477,596 | 11/1969 | Michaelson et al. | 214/147 G |
| 3,782,567 | 1/1974 | Likas et al. | 294/88 |
| 3,840,128 | 10/1974 | Swoboda, Jr. et al. | 214/147 G |

*Primary Examiner*—James B. Marbert

*Attorney, Agent, or Firm*—Haseltine, Lake & Waters

[57] ABSTRACT

A hydraulically operated grapple or timber fork provided with a wire tightened on the load to prevent the load from disarranging and falling out of the fork. The wire tension is obtained by a hydraulically operated stretcher. In order to ensure that the wire stretcher in all positions can be supplied with hydraulic fluid under pressure, a pressure accumulator is positioned between a hydraulic pressure source and the hydraulically operated wire stretcher.

6 Claims, 2 Drawing Figures

HYDRAULICALLY OPERATED GRAPPLE OR TIMBER FORK

FIELD OF THE INVENTION

This invention relates to a hydraulically operated grapple or timber fork provided with a wire tightened on the load (log bundle or the like). The wire prevents the load from becoming disarranged and/or falling out of the fork. By its pressure, the wire has a stabilizing effect on the upper part of the load and, in the case of voluminous loads, also on its sides. The load is thereby easier to handle and, when it consists of logs, the logs are easier to orientate and maintain their correct position in the fork. The wire must always be adjustable in length, due to the position of the hydraulic grapple member, and at the same time its tension must be maintained in order to achieve the desired effect.

BACKGROUND

In a previously known device for solving the problem of providing the wire with adjustable length and approximately constant tension, one end of the wire was made to co-operate with a hydraulic stretching device. This device has not proved to be completely successful, because the wire tension produced by the pressure fluid in the system could not always be ensured to be sufficient. There is a risk, that the hydraulic system at certain grapple movements and by internal leakage at times is not capable of supplying the wire stretcher with pressure fluid to maintain the wire sufficiently stretched.

SUMMARY OF THE INVENTION

The aforesaid problem is solved according to the invention by the provision of a hydraulically operated grapple or timber fork comprising an openable and closable fork arm, a wire connected to said fork arm, a hydraulic cylinder for operating said fork arm, and a hydraulically operated wire stretcher coupled to said wire to stretch the same, such that the wire can contact a load carried by the fork and prevent the load from disarranging and/or falling out of the fork. The grapple or timber fork is characterized by a hydraulic circuit connecting a hydraulic pressure source with the hydraulically operated wire stretcher and with the hydraulic cylinder to effect operation of the stretcher conjointly with said cylinder, and pressure accumulator means in said circuit between the hydraulic pressure source and the hydraulically operated wire stretcher for being pressurized during operation of said cylinder for supplying the wire stretcher temporarily with pressure fluid if said pressure source is cut off.

BRIEF DESCRIPTION OF THE DRAWING

An embodiment of the invention is described in the following with reference to the accompanying drawings, in which.

DETAILED DESCRIPTION

Figure 1:
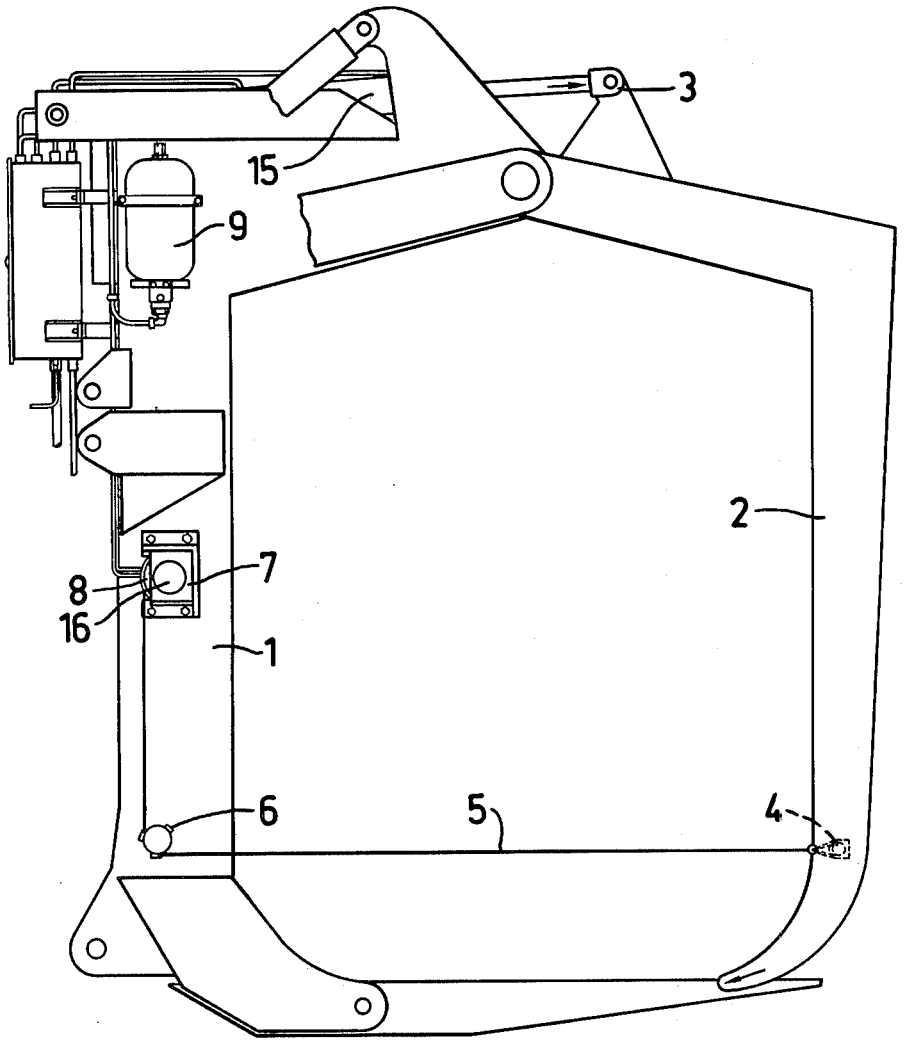
FIG. 1 is a side view of the fork according to the invention.
Figure 2:
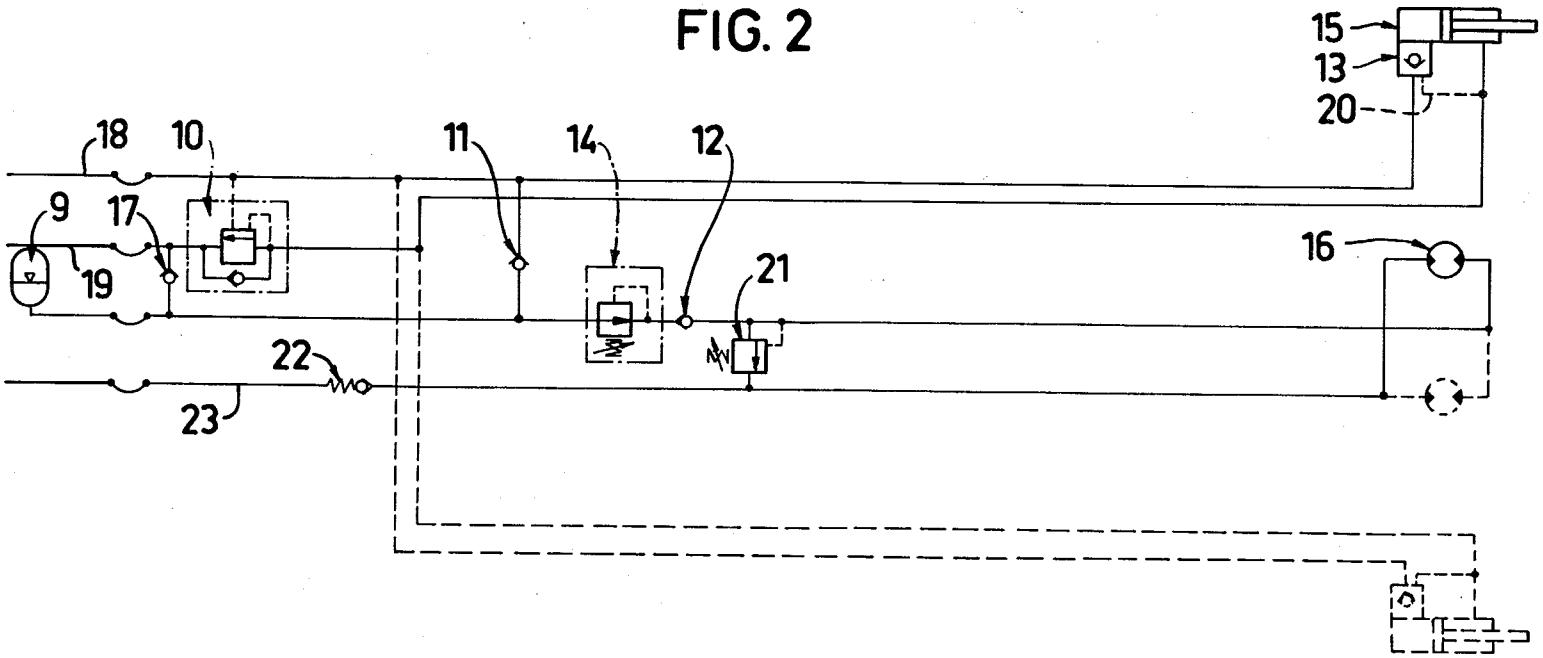
FIG. 2 shows a hydraulic coupling diagram for a fork according to the invention.

FIG. 1 shows a hydraulically operated fork with a fork arm 2 mounted directly or indirectly on the stand 1. The arm 2 is connected to a double-acting hydraulic cylinder 15 via a joint 3. To the lower end 4 of the arm 2 a wire 5 is attached which extends horizontally to the stand 1 where it runs over a pulley 6 to a wire stretcher 7. The wire stretcher 7 comprises a wire drum 8 driven by a hydraulic motor 16. A pressure accumulator 9 is mounted on the stand 1. FIG. 2 shows the function of the fork where the pressure accumulator 9 can be charged via an inlet conduit 18 from the pressure source and via a check valve 11. At a grapple movement or closing of the fork arm 2, pressure fluid is thus led via the conduit 18 to the outer chamber of the hydraulic cylinder 15, and at the same time the hydraulic motor 16 of the wire stretcher 7 receives working fluid via the check valve 11 and via a pressure reducing valve 14, which reduces the pressure to 55–60 bar. The hydraulic motor 16, thus, acts on the drum 8 of the wire stretcher 7 with a "wind-up" moment, which ensures the tension in the wire which in turn provides the stabilizing effect on the load. In the case when the fork arm 2 during its initial grapple movement, does not meet resistance from the load, for example at loading and unloading of shaped log bundles, the arm 2 "sinks" as pressure fluid is led into the hydraulic cylinder 15, and the system practically becomes pressureless. In this case, the stabilizing effect produced by the wire on the load can be necessary. In order then to ensure the operation of the hydraulic motor 16 of the wire stretcher 7 and the charging of the pressure accumulator 9, a controlled counterhold valve 10 has been provided in connection to the inner chamber of the hydraulic cylinder. By this arrangement, a pressure corresponding to about 25 bar in the outer chamber of the cylinder 15 is required, before the counterhold valve 10 opens and permits pressure fluid to leave the inner chamber of the cylinder 15. Hereby sufficient pressure is available in the outer chamber of the hydraulic cylinder 15 and, consequently, this pressure can be applied also to drive the hydraulic motor 16 and to charge the pressure accumulator 9. Said accumulator has the function of ensuring the supply of pressure fluid to the hydraulic motor 16 of the wire stretcher. In order to prevent the hydraulic cylinder 15, after completion of the grapple movement of the arm 2, from having to be under pressure, and as yet a tension in the wire is desired, the stored pressure in the accumulator 9 ensures operation of the hydraulic motor 16, which via the drum 8 provides the desired wire tension. When the pressure accumulator 9 due to internal leakage of the hydraulic motor, is emptied of oil before the load has been delivered, then the accumulator 9 can be charged as the outer chamber of the hydraulic cylinder is put under pressure for several seconds.

In order to prevent the leakage of pressure fluid from the outer chamber of the hydraulic cylinder 15 via the pressure reducing valve 14 and the hydraulic motor to the tank, the cylinder connection has been provided with a pressure-controlled check valve 13, which prevents the fork from dropping the load, even in the case of hose break.

At an opening movement of the fork arm 2, pressure fluid is led via the conduit 19 through a check valve in the counterhold valve 10 to the inner chamber of the hydraulic cylinder. At the same time pressure fluid is led via the check valve 17 to the pressure accumulator 9 and via the pressure reducing valve 14 to the hydraulic motor 16 of the wire stretcher 7, and via the conduit 20 to the pressure-controlled check valve 13 at the hydraulic cylinder 15. The check valve 13 then opens and permits fluid to flow out from the outer chamber of the cylinder 15.

When the fork arm 2 opens, the wire 5 is pulled out, whereby the hydraulic motor 16 is forced to rotate against the pressure of fluid. The motor 16 then acts as a pump and pumps pressure fluid through a pressure limiting valve 21 with a pressure of 65–70 bar. A check valve 22 in the return conduit 23 has an opening pressure of about 3 bar, so that the pressure fluid tends to flow back to the hydraulic motor 16.

The embodiment described above has referred to a fork with only one hydraulically operated fork arm and only one wire stretcher. It is, of course, possible to apply the invention to a fork with more than one fork arm and more wire stretchers. In FIG. 2 the dashed lines and the details co-operating therewith indicate an embodiment with two hydraulically operated fork arms and two wire stretchers driven by hydraulic motor.

It is also possible, in practice, to choose a hydraulic motor with adjustable torque for the wire stretcher. The adjustment can be effected by controlling the flow rate and number of revolutions of the hydraulic motor.

What I claim is:

1. A hydraulically operated grapple comprising an openable and closable fork, a hydraulic cylinder for operating said fork, a wire connected to said fork, a hydraulically operated wire stretcher coupled to said wire to stretch the same such that the wire can contact a load carried by the fork and prevent the load from disarranging and/or falling out of the fork, a hydraulic circuit connecting a hydraulic pressure source, said hydraulically operated wire stretcher and said hydraulic cylinder to effect operation of said stretcher conjointly with said cylinder, and pressure accumulator means in said circuit between said hydraulic pressure source and said hydraulically operated wire stretcher for being pressurized during operation of said cylinder for supplying the wire stretcher temporarily with pressure fluid if said pressure source is cut off.

2. A grapple as claimed in claim 1 wherein said wire stretcher comprises a hydraulic motor and a wire drum driven by said hydraulic motor and permitting winding on and off of the wire depending on the movement of the fork.

3. A grapple as claimed in claim 2 wherein said hydraulic motor is connected in the hydraulic circuit to operate as a pump with controlled counterpressure during opening of the fork.

4. A grapple as claimed in claim 1 wherein said circuit includes at least one check valve between the pressure source and the pressure accumulator means to permit charging of the accumulator means by applying pressure to the hydraulic cylinder which at the time in question is pressureless.

5. A grapple as claimed in claim 1 wherein said circuit includes a counterhold valve connected to the hydraulic cylinder so that hydraulic medium is permitted to leave the hydraulic cylinder during closure of the fork only after a pressure determined by the counterhold valve has been achieved.

6. A grapple as claimed in claim 1 wherein said circuit includes an adjustable pressure controlled check valve on said hydraulic cylinder at the inlet thereof of the chamber which is pressurized to close said fork.

* * * * *